United States Patent [19]

Shindo et al.

[11] Patent Number: 5,044,869

[45] Date of Patent: Sep. 3, 1991

[54] FORKLIFT FORKHOOK HAVING DAMS ADJACENT ITS VERTICAL CONTACT SURFACE TO CONFINE MOLTEN WELD MATERIAL

[75] Inventors: Yoshihiro Shindo; Masanao Kobayakawa; Kochi Maruyama, all of Kariya, Japan

[73] Assignee: Kabushiki Kaisha Toyoda Jidoshokki Seisakusho, Kariya, Japan

[21] Appl. No.: 523,010

[22] Filed: May 14, 1990

[30] Foreign Application Priority Data

May 17, 1989 [JP] Japan ..... 1-56896[U]

[51] Int. Cl.[5] ..... B66F 9/12

[52] U.S. Cl. ..... 414/785; 228/165; 228/215

[58] Field of Search ..... 414/785, 607, 608, 664–667, 414/629, 631; 228/165, 166, 167, 215, 142, 144; 403/271

[56] References Cited

U.S. PATENT DOCUMENTS

| | | | |
|---|---|---|---|
| 1,764,617 | 6/1930 | Ford | 228/165 |
| 2,813,333 | 11/1957 | Pompa | 228/165 |
| 3,750,266 | 8/1973 | Hikido et al. | 228/215 |
| 4,136,811 | 1/1979 | Sato | 228/165 |
| 4,208,563 | 6/1980 | Frantzreb et al. | 228/215 X |
| 4,349,717 | 9/1982 | Lindow et al. | 228/215 X |

FOREIGN PATENT DOCUMENTS

| | | | |
|---|---|---|---|
| 2246937 | 4/1974 | Fed. Rep. of Germany | 414/785 |
| 3710573 | 10/1988 | Fed. Rep. of Germany | 414/785 |
| 58-12598 | 7/1983 | Japan | 414/785 |
| 2150112 | 10/1984 | United Kingdom | 414/785 |

*Primary Examiner*—Frank E. Werner
*Assistant Examiner*—Brian K. Dinicola
*Attorney, Agent, or Firm*—Brooks Haidt Haffner & Delahunty

[57] ABSTRACT

A forkhook has a beveled portion formed on the periphery thereof so as to be welded to a fork. Dams are provided at corners of the beveled portion to prevent the liquid weld bead from dropping to the outer peripheral areas. Also, dams are provided between the beveled portion and the groove for receiving a locking pin to prevent the liquid weld bead from dropping into the groove. Thus, the operation for welding the forkhook to the fork is facilitated.

7 Claims, 5 Drawing Sheets

FORKLIFT FORKHOOK HAVING DAMS ADJACENT ITS VERTICAL CONTACT SURFACE TO CONFINE MOLTEN WELD MATERIAL

FIELD OF THE INVENTION

The present invention relates generally to a forkhook for a forklift, and more particularly to a forkhook for hooking a fork on a liftbracket.

BACKGROUND ART

As shown in FIG. 1, a fork 1 for use in a forklift consists of a vertical portion 1*a* and a horizontal portion 1*b*. The vertical portion 1*a* of the fork 1 has an upper forkhook 3 welded to the upper rear surface thereof, which is hooked on a fork receiving bar or a finger bar 7 mounted on the front upper portion of a liftbracket 5. Also, the vertical fork portion 1*a* has a lower forkhook 9 welded to the lower rear surface thereof, which is engaged with a lower bar 11 on the front lower portion of the liftbracket 5.

FIG. 2 shows an example of a prior construction of an upper forkhook 3. This forkhook 3 has a beveled portion formed by chamfering the peripheral edge portions around the area where the forkhook is to be welded to the fork. Thus, each corner portion 15 at which a horizontal beveled surface and a vertical beveled surface of the bevel portion intersect presents a substantially rounded shape as shown in FIG. 3. A flat front surface or a contact surface 17 of this forkhook 3 which contacts the fork 1 is circumscribed by the beveled portion, and a groove 19 which, together with the fork 1, defines a pin hole extending vertically on the substantially central portion of the contact surface 17. Therefore, inclined edge portions 21 are formed between the upper and lower horizontal bevel surfaces of the beveled portion and the groove 19, respectively.

Such a forkhook 3 is fixed on the rear surface of the vertical fork portion 1*a* by welding as shown in FIGS. 4 and 5. More specifically, the vertically disposed flat contact surface 17 of the forkhook 3 is held against the upper rear surface of the vertical fork portion 1*a* and the beveled portion about the contact surface 17 is overlaid with a weld 23.

Thus, when the forkhook 3 is attached to the fork 1, the groove 19 cooperates with the rear surface of the fork 1 to define the above-mentioned pin hole. As shown in FIGS. 1 and 4, a hub member 25 is disposed in this pin hole 19, and a locking pin 27 is detachably inserted into the hub member 25. As shown in FIG. 6, this locking pin 27 has a knob 29 attached at the upper end thereof, and a stopper pin 31 extends transversely through the lower portion of the knob 29. As best shown in FIG. 7, the hub member 27 has a through hole 33 and stopper notches 35 for engaging with the stopper pin 31. When the fork 1 is attached to the liftbracket, the locking pin 27 is inserted into the through hole 33 of the hub member 25 and the stopper pin 31 is engaged within the stopper notches 35 of the hub member 25. Concurrently, the locking pin 27 is inserted into a corresponding engaging hole 37 on the finger bar 7 of the liftbracket 5 to prevent the transverse movement of the fork 1.

However, when the forkhook 3 is being welded to the fork 1, the welding operation at the corner portions 15 of the beveled portion is difficult, and in particular the molten liquid weld bead is liable to drop from there. Also, the weld bead may drop from the inclined edge portions 21 into the groove 19. If the weld bead adheres on the side wall of the groove 19, the disposition of the hub member 25 will be unsatisfactory, and in the worst case the insertion of the locking pin 27 will be impossible.

Moreover, it is difficult to set the welding aim position. Further, when intending to prevent the dropping of the weld bead, it is difficult to maintain an appropriate attitude for the welding operation.

SUMMARY OF THE INVENTION

Accordingly, the object of the present invention is to provide an improved forkhook which prevents a weld bead from dropping from the bevel surfaces of a beveled portion and which facilitates welding operations.

To achieve the above object, the present invention, in accordance with its first embodiment, is characterized in that a forkhook having a contact surface to be welded against a vertical surface of a fork has beveled edge portions extending along the periphery of the contact surface thereof, the beveled surfaces having banks or dams provided at its corner portions at which adjacent bevel surfaces would otherwise intersect, the leading edge or upper surfaces of the banks or dams being flush with the contact surface.

Herein, "beveled portion" means that portion of the forkhook which is formed with tapered surfaces, i.e. chamfered or beveled bevel surfaces for forming a padding of weld bead.

With this construction, when the forkhook is being welded to the fork, the liquid weld bead will not drop to the outer peripheral areas of the corner portions of the bevel portion because the banks function as weld bead flow stoppers. As a result, the welding aim position can be readily set especially at the corner portions. Also, an appropriate attitude can be maintained during the welding operation.

Also, the present invention, in accordance with its second embodiment, is characterized in that a forkhook having a groove on a generally central portion of the contact surface for receiving a locking pin includes similar dams provided at edge portions at which the groove and the beveled surfaces of the beveled portion would otherwise intersect.

In this case, the weld bead will not drop into the groove during the welding. Therefore, the efficiency of the finishing operation of the interior of the groove after welding can be enhanced or simplified.

These and other objects and features of the present invention will become apparent from the following detailed explanation in conjunction with the attached drawings.

BRIEF DESCRIPTION OF THE DRAWINGS

In the course of the following detailed description, reference will be made to the attached drawings in which.

DETAILED DESCRIPTION OF PREFERRED EMBODIMENTS

Figure 1:
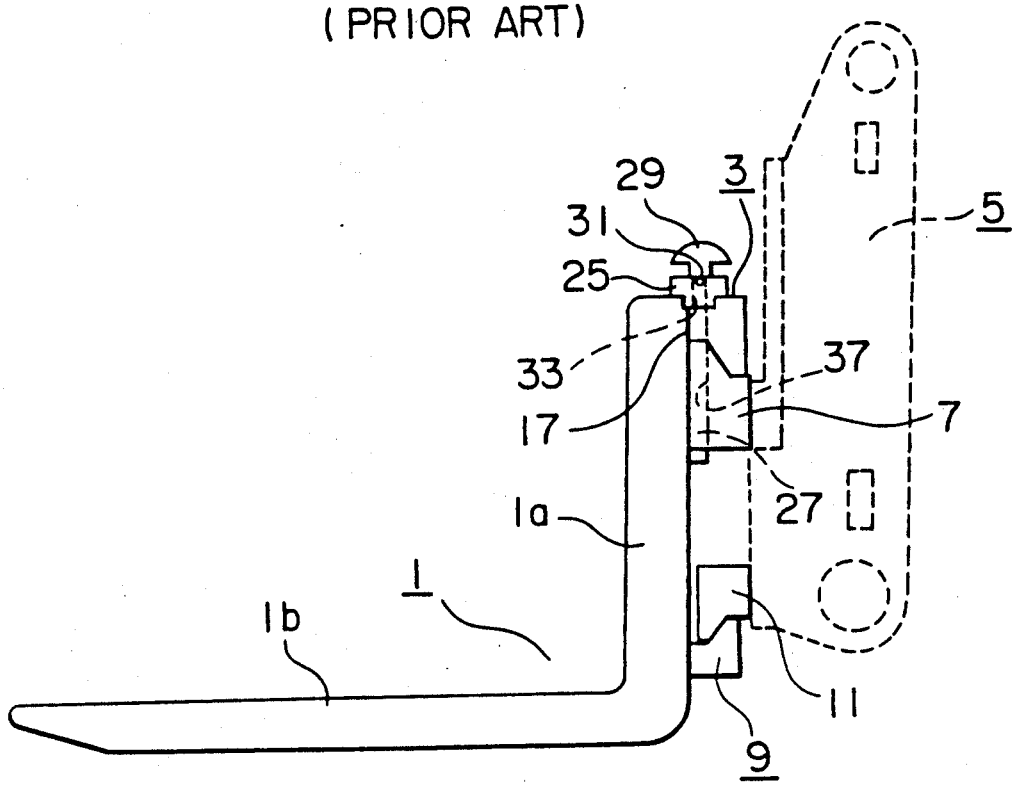
FIG. 1 (PRIOR ART)
FIG. 1 is a side view showing a forkhook and a fork in a welded state.
Figure 2:
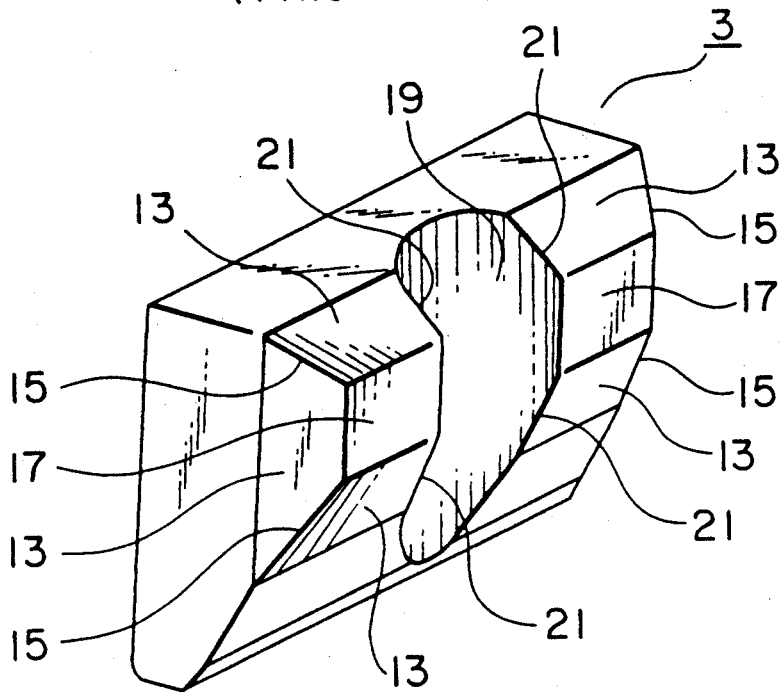
FIG. 2 (PRIOR ART)
FIG. 2 is a perspective view of a prior forkhook.
Figure 3:
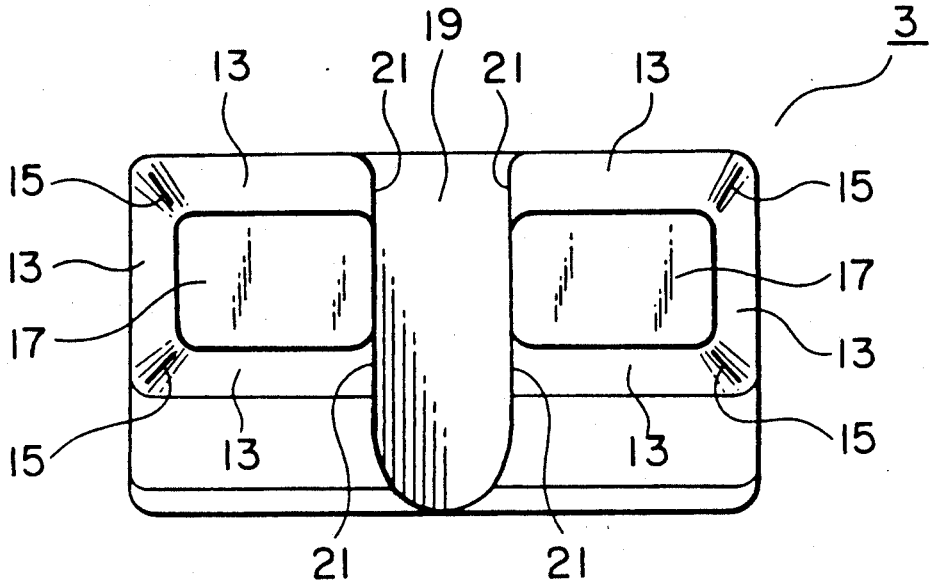
FIG. 3 (PRIOR ART)
FIG. 3 is a front view of the forkhook of FIG. 2.
Figure 4:
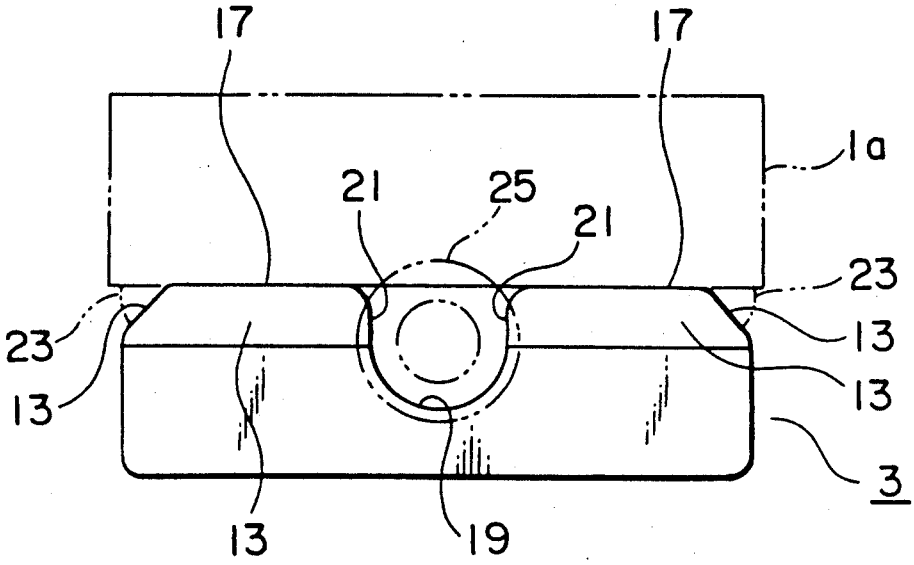
FIG. 4 (PRIOR ART)
FIG. 4 is a plan view of the forkhook of FIG. 2, showing the forkhook and the fork in a welded state.
Figure 5:
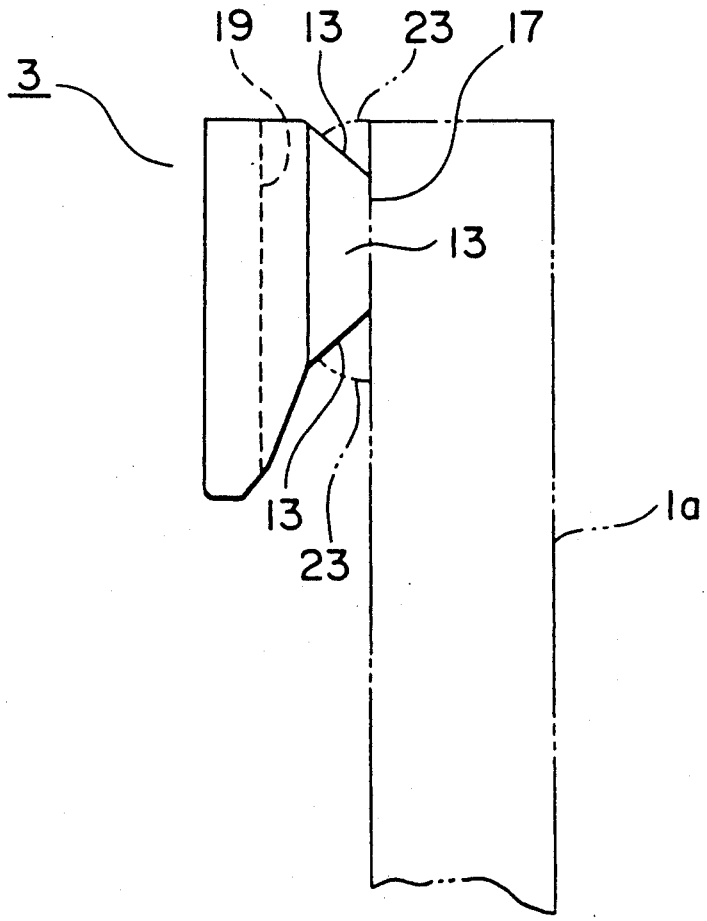
FIG. 5 (PRIOR ART)
FIG. 5 is a side view of the forkhook of FIG. 2, showing the forkhook and the fork in a welded state.
Figure 6:
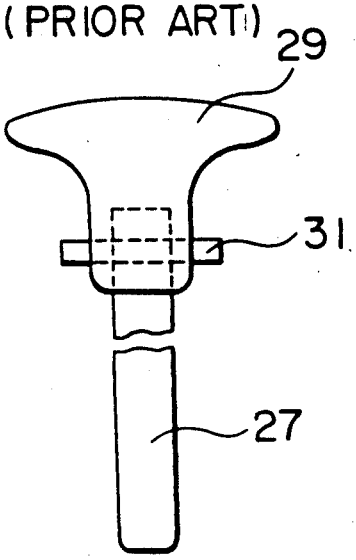
FIG. 6 (PRIOR ART)
FIG. 6 is an enlarged and longitudinally fragmented side view of a locking pin.
Figure 7:
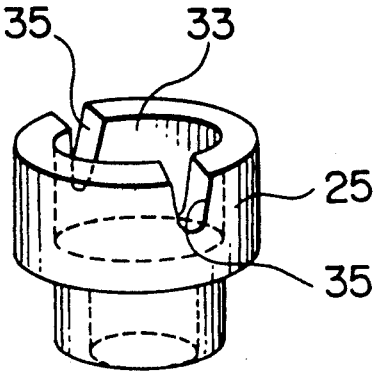
FIG. 7 (PRIOR ART)
FIG. 7 is an enlarged perspective view of a hub member.
Figure 8:
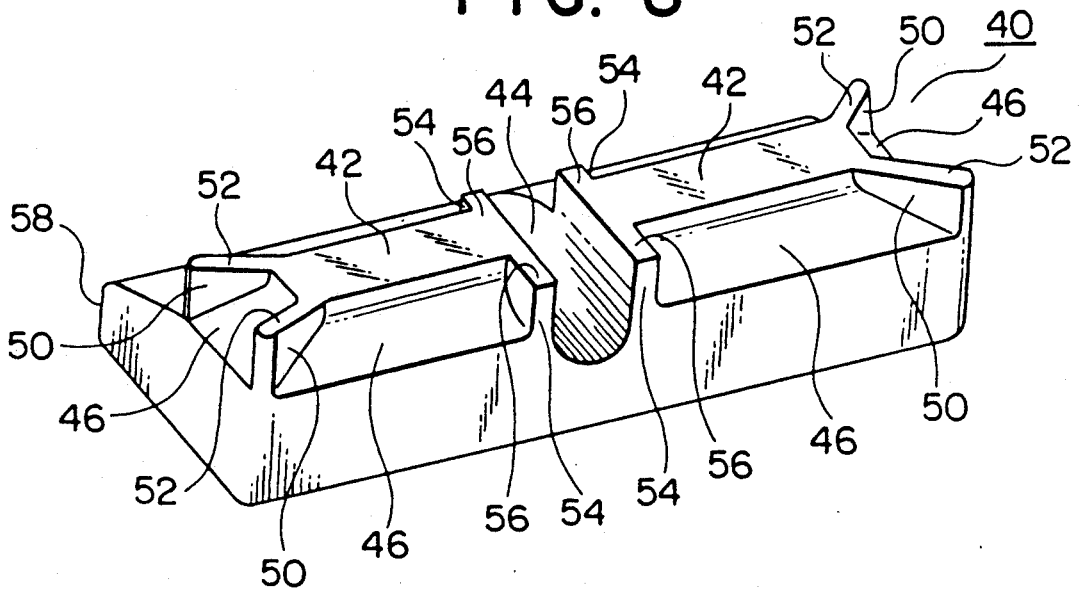
FIG. 8 is a perspective view of a first embodiment of a forkhook in accordance with the present invention.
Figure 9:
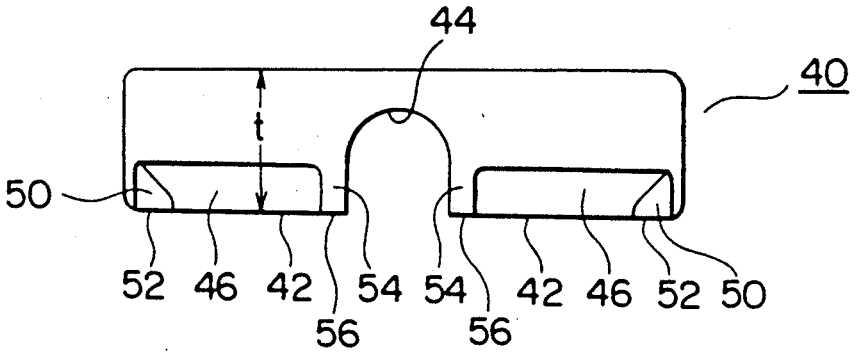
FIG. 9 is a plan view of the forkhook of FIG. 8.
Figure 10:
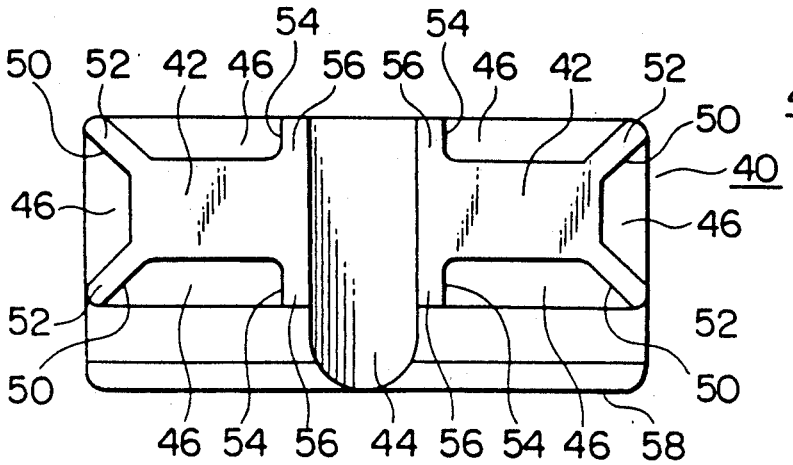
FIG. 10 is a front view of the forkhook of FIG. 8.
Figure 11:
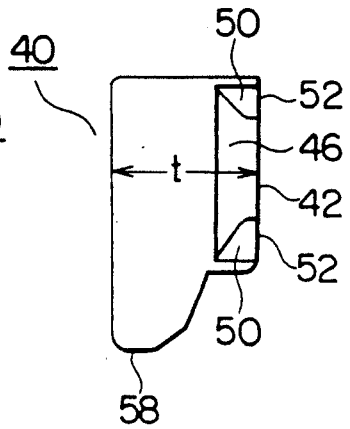
FIG. 11 is a side view of the forkhook of FIG. 8.

Referring now to FIGS. 8–11, there is shown a first embodiment of a forkhook in accordance with the present invention, being generally designated by the numeral 40. This forkhook 40 is the one that is attached to an upper end portion of a vertical part of a fork (corresponding to the forkhook 3 of FIG. 1). A substantially central portion of a contact surface 42 of the forkhook 40 has what will be a vertically disposed groove 44 formed therein which cooperates with the rear surface of the fork to define a pin hole for receiving a vertical locking pin such as shown FIG. 6. The groove 44 has a substantially semi-cylindrical shape and is formed for a hub member such as shown in FIG. 7 to snugly fit therein.

A beveled portion for welding to the fork is formed on and substantially along the periphery circumscribing the contact surface 42 of the forkhook 40. This beveled portion is provided with dams 50 at corner portions, interposed where the angled surfaces 4l of the adjacent beveled portions would otherwise intersect. Each of these dams 50 extends radially or obliquely outward from the contact surface 42 to the corresponding corner portions of the forkhook 40, and perpendicular to the surface 42. Each dam 52 extends at an obtuse angle with respect to the direction of the length of each of the beveled surfaces 46 between which it is interposed. Also, similar dams 54 are provided at edge portions where the groove 44 and the horizontal bevel surfaces 46 would otherwise intersect. These dams 50, 54 are formed so that their uniform height is equal to the height of the contact surface 42 of the forkhook 40. In other words, the upper or leading edge surfaces 52, 56 of the dams 50, 54 are flush with the contact surface 42. Therefore, the dams 50, 54 and the contact surface 42 are formed by cutting the necessary bevel surfaces 46 out of the base material of the forkhook 40.

These dams 50, 54 have a uniform width, preferably of about 2.5 mm, and the thickness t of the forkhook 40 is preferably about 25 mm. Further, the forkhook 40 has a protruding portion 58 at the lower edge thereof for mating with a finger bar of a liftbracket (Refer to FIG. 1).

In such a forkhook 40, the dams 54 at the edge portions of the groove 44 can closely contact the rear surface of the fork because the dams 54 are flush with the contact surface 42. Moreover, one side of each dam 54 forms a continuation of the groove 44 across each beveled surface 46, and the opposite side faces, and is perpendicular to the length of the beveled surfaces 46 and to the contact surface 56. Therefore, when the forkhook 40 is being welded to the fork, the weld bead will not drop into the groove 44. Consequently, after the welding, the efficiency of the finishing operation of the interior of the groove 44 can be enhanced or simplified.

Similarly, as the dams 50 can closely contact the fork, the weld bead will not drop to the outer peripheral areas of the corner portions when the forkhook 40 is being welded to the fork. Therefore, the welding aim position can be readily set at the corner portions. Also, an appropriate attitude can be maintained during the welding operation.

Figure 12:
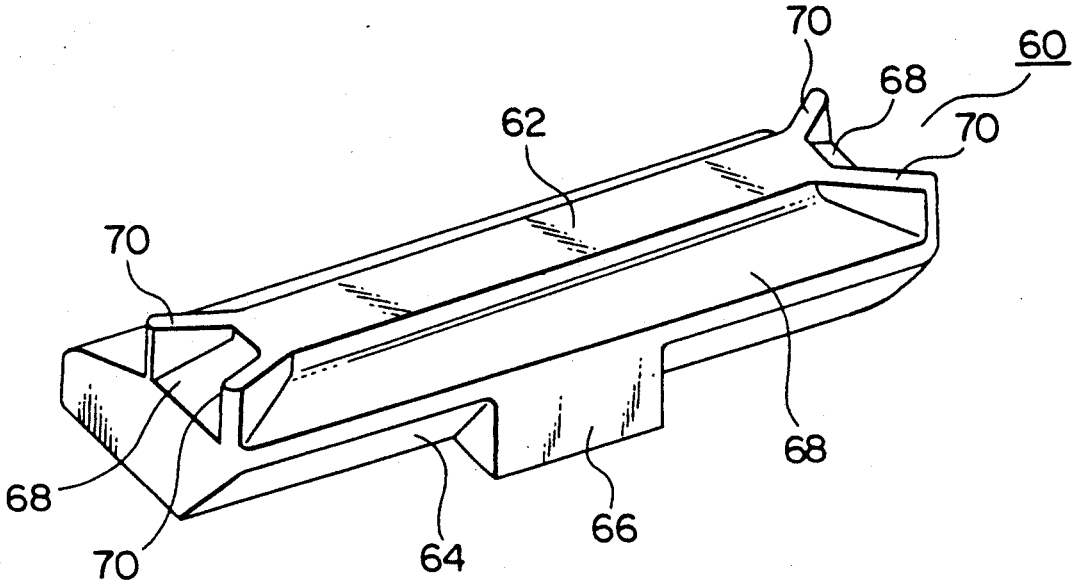
FIG. 12 is a perspective view of a second embodiment of a forkhook in accordance with the present invention.
Figure 13:
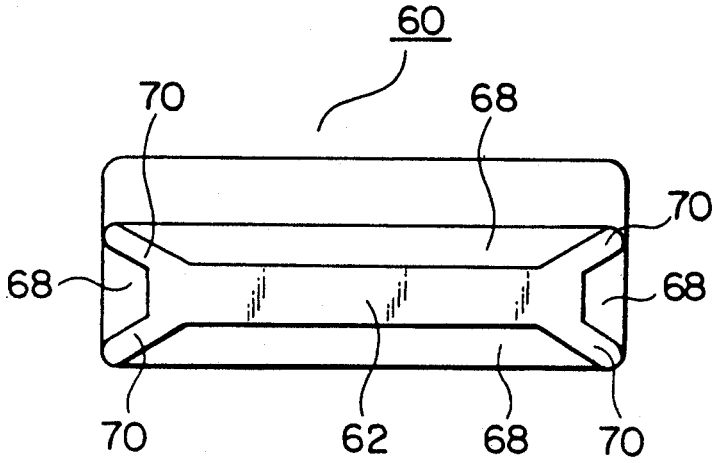
FIG. 13 is a front view of the forkhook of FIG. 12.
Figure 14:
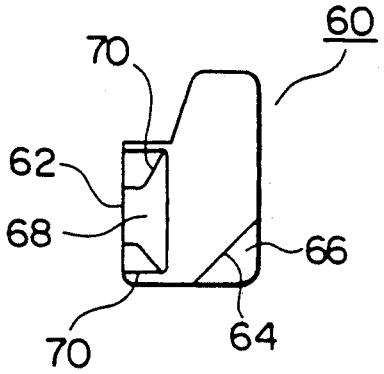
FIG. 14 is a side view of the forkhook of FIG. 12.

Next, referring to FIGS. 12–14, there is shown a second embodiment of a forkhook in accordance with the present invention, being generally designated by the numeral 60. This forkhook 60 is the one that is attached to the lower end portion of a vertical fork portion (corresponding to the forkhook 9 of FIG. 1). The contact surface 62 of the forkhook 60 does not have a groove for defining a pin hole for receiving a locking pin, but it does have an engaging portion 66 protruding from tapered surface 64, at a substantially central portion thereof.

Such a forkhook 60 has, in a peripheral beveled portion, only banks 70 at corner portions where the adjacent bevel surfaces 68 would otherwise intersect. Therefore, similarly to the first embodiment, the weld bead will not drop to the outer peripheral areas of the corner portions when the forkhook 60 is being welded to the fork. Consequently, the welding aim position can be readily set especially at the corner portions. Also, an appropriate attitude can be maintained during the welding operation.

It is thought that the present invention and many of its attendant advantages will be understood from the foregoing description and it will be apparent that various changes may be made in the form, construction and arrangement thereof without departing from the spirit and scope of the invention or sacrificing all of its material advantages, the form hereinbefore described being merely a preferred or exemplary embodiment thereof.

What is claimed is:

1. A forkhook for welding to a vertical surface of a fork of a forklift, said forkhook having a normally vertical contact surface for contacting said vertical surface of said fork and an elongated beveled surface extending along at least one side of said contact surface whereby, when said contact surface is in contact with said vertical surface of said fork a gap is provided between said beveled surface and said vertical surface of said fork for receiving molten weld material for welding said forkhook to said fork, and a dam at each of the opposite ends of said elongated beveled surface for retaining said weld material during said welding of said forkhook to said vertical surface of the fork, each of said dams extending outwardly from and across said elongated beveled surface and having an upper surface flush with said contact surface and a side surface facing said beveled surface.

2. A forkhook according to claim 1, wherein said side surface of each said dam facing each said elongated beveled surface extends outwardly at an obtuse angle with respect to the length of said elongated beveled surface and substantially perpendicular to said forkhook contact surface.

3. A forkhook according to claim 1, wherein said forkhook contact surface is substantially rectangular and has a plurality of said elongated beveled surfaces extending along respective peripheral sides of said rectangular contact surface, and respective dams are interposed between respectively adjacent ones of said beveled surfaces, each of said dams being at a corner of, and extending outwardly from said elongated beveled surfaces between which it is interposed and having an upper surface flush with said forkhook contact surface and respectively opposite side surfaces each facing, and extending at an obtuse angle with respect to the length of that of said elongated beveled surfaces which it faces, each said dam side surface being perpendicular to said forkhook contact surface.

4. A forkhook according to claim 3, wherein each of said dams has a width which is substantially equal to said width of each other of said dams.

5. A forkhook according to claim 3, wherein said forkhook has a normally vertically disposed groove formed within said forkhook contact surface for receiving a locking pin for locking the forkhook and the fork to a lift bracket when said forkhook is welded to said vertical surface of the fork, said groove extending transversely across a substantially parallel pair of said elongated beveled surfaces extending respectively along opposite sides of said rectangular contact surface, and which further comprises additional of said dams interposed between said groove and said pair of beveled surfaces respectively at each location where said groove extends across one of said beveled surfaces, each of said additional dams having an upper surface flush with said contact surface, a side surface forming a contination of said groove across said forkhook, and an opposite side surface facing, and extending perpendicularly with respect to the length of that one of said elongated beveled surfaces which it faces and perpendicular to said forkhook contact surface.

6. A forkhook according to claim 5, wherein each of said dams has a width which is substantially equal to said width of each other of said dams.

7. A forkhook according to claim 5, wherein all of said elongated beveled surfaces and all of said dams are formed integrally with said forkhook.

* * * * *